United States Patent [19]

Godyak et al.

[11] Patent Number: 4,952,844

[45] Date of Patent: Aug. 28, 1990

[54] ELECTRONIC BALLAST CIRCUIT FOR DISCHARGE LAMP

[75] Inventors: Valery Godyak, North Andover; Fred Whitney, Salem, both of Mass.

[73] Assignee: GTE Products Corporation, Danvers, Mass.

[21] Appl. No.: 290,617

[22] Filed: Dec. 27, 1988

[51] Int. Cl.[5] ..... H05B 37/00

[52] U.S. Cl. ..... 315/205; 315/362

[58] Field of Search ..... 315/101, 205, 227 R, 315/362

[56] References Cited

U.S. PATENT DOCUMENTS

| | | | |
|---|---|---|---|
| 2,356,369 | 12/1941 | Abernathy . | |
| 3,787,751 | 1/1974 | Farrow . | |
| 4,122,374 | 10/1978 | Stüdli | 315/101 X |
| 4,172,981 | 10/1979 | Smith . | |
| 4,288,725 | 9/1981 | Morton . | |
| 4,500,812 | 2/1985 | Roche . | |
| 4,518,897 | 5/1985 | Proud et al. . | |

OTHER PUBLICATIONS

Kaneda et al., "Study of High Output Circuits for Preheat Type Fluorescent Lamps", New Nippon Electric Technical Review, vol. 3, No. 1 (1968), pp. 26–36.

Capacitor Ballast for a Compact Fluorescent Lamp—Yoshio Watanabe—J. Light & Vis. Env. vol. 7, No. 1 1983 (pp. 7–14).

Single-Ended Compact Fluorescent Lamp with Multi--Arc Caused by Anode Oscillations—Watanabe et al—-Journal of IES/Jul. 1982 (pp. 216–222).

*Primary Examiner*—Robert J. Pascal

*Attorney, Agent, or Firm*—Carlo S. Bessone

[57] ABSTRACT

An electronic capacitive ballast circuit for operating a DC discharge lamp, such as a negative glow lamp. The circuit includes a rectifier bridge intercoupling a ballast capacitor and the electrodes of the discharge lamp. The rectifier bridge is separated into two halves allowing the discharge current to flow to opposite ends of the filament of the lamp during alternating half-cycles so that the filament (i.e., cathode) is operated in a double hot spot regime. As a result, lamp maintenance and performance are improved.

15 Claims, 1 Drawing Sheet

ELECTRONIC BALLAST CIRCUIT FOR DISCHARGE LAMP

FIELD OF THE INVENTION

The present invention relates in general to ballast circuits for lamps, and pertains, more particularly, to electronic ballast circuits, particularly for use with electric discharge lamps.

BACKGROUND OF THE INVENTION

One conventional electronic ballast circuit is one that employs an inductive ballast, typically dropping about 80% of the line voltage across the ballast element. There are many applications in which such an inductive ballast is effective. However, for in particular, low voltage, high current electric discharge lamps, such as negative glow lamps, an inductive ballast is highly inefficient. For example, in the particular case of a 15 volt high current negative glow lamp, undesirably substantially all of the RMS line voltage would be dropped across the ballast element.

Accordingly, the use of an inductive ballast for this type of lamp for a low voltage high current discharge lamp results in poor lamp efficiency. Because of the relatively high currents required by these lamps, the corresponding Joule heating loss ($I^2R$, eddy current, hysteresis, etc.) is much higher than for a lamp operating at lower currents. In this regard, the higher current referred to would be in the range of 2–5 amps and the lower currents would be less than one amp. Accordingly, it is desirable because of these poor efficiencies associated with inductive ballasts to instead provide a more efficient ballast circuit, particularly for use with discharge lamps including DC glow discharge lamps.

Prior U.S. patents that describe the use of capacitive ballasts with or without rectifier circuits include U.S. Pat. No. 2,356,369 to Abernathy; U.S. Pat. No. 4,288,725 to Morton; U.S. Pat, No. 4,172,981 to Smith; U.S. Pat. No. 4,500,812 to Roche; and U.S. Pat. No. 3,787,751 to Farrow. Modifications to inductive ballasts have been carried out. For example, inductive ballasts can be designed so that resistive and magnetic power losses are minimized. However, to minimize both the ballast weight and system power losses, a capacitive ballast is preferred, particularly for negative glow, low pressure discharge lamps, a capacitive ballast in conjunction with a bridge rectifier has been employed in the prior art. In this regard, refer to, for example, the article "Capacitor Ballast for a Compact Fluorescent Lamp" by Watanabe, J. Light & Vis. Env., Vol. 7, No. 1, 1983, pp. 7–14. In this article, refer in particular to the circuit of FIG. 17 employing the combination of a bridge rectifier and capacitor ballast.

Reference is also made herein to FIG. 1 for an illustration of the use of a capacitor ballast in conjunction with a full-wave rectifier bridge for operating a low voltage, high current DC discharge lamp. More particularly, FIG. 1 illustrates the ballast element as capacitor C. The full . wave rectifier bridge is comprised of diodes D1–D4 interconnected in the normal bridge rectifier configuration. The input AC signal which typically is a 120 volt AC signal is coupled at the terminals 10. The terminals 10 connect in series with the capacitor C to the input of the full-wave rectifier bridge. The output of the full-wave rectifier bridge may be considered as coupling to the glow discharge lamp 12.

The glow discharge lamp 12 is comprised of an anode 14 and a cathode 16. Also illustrated in FIG. 1 is the switch 20. The switch 20 couples, in one position thereof, across the cathode 16. The operation of the switch 20 is well known and as the construction thereof forms no part of the present invention, it is not described in any great detail herein. It is efficient to state that the switch 20 is operable for lamp starting. Refer, for example, to similar starting switch configurations found in U.S. Pat. No. 2,356,369 or U.S. Pat. No. 4,288,725 previously referred to.

One of the drawbacks associated with the electronic ballast circuit of FIG. 1 is the characteristic of the circuit of operating with a single hot spot operation regime for the lamp cathode. This is illustrated by the arrows 18 in FIG. 1. In essence, the discharge current flows to the same point on the cathode, as illustrated by arrows 18, during each half cycle of the AC signal.

SUMMARY OF THE INVENTION

Accordingly, it is an object of the present invention to provide an improved electronic ballast circuit, particularly an electronic ballast circuit for use in powering low voltage, high current discharge lamps.

Another object of the present invention is to provide an improved electronic ballast circuit that operates a discharge lamp in a double hot spot operation regime for the lamp cathode so as to provide improved cathode operation and maintenance.

A further object of the present invention is to provide improved electronic ballast circuit for driving a DC discharge lamp in which two cathode hot spots are formed during lamp operation so as to improve maintenance of the cathode by preventing continuous evaporation from any one point on the cathode during lamp operation.

Still another object of the present invention is to provide an improved electronic ballast circuit in accordance with the preceding object and which furthermore provides for more even heating of the cathode with attendant improved lamp maintenance and performance.

These and other objects, advantages and capabilities are achieved in one aspect of the invention by an electronic ballast circuit for operating a discharge lamp such as a DC glow discharge lamp, typically operated from an AC source. The electronic ballast circuit includes a capacitive ballast element and a bridge rectifier circuit that essentially intercouples the ballast element and the discharge lamp. The bridge rectifier circuit includes means operable during a first half-cycle of the AC signal to provide a lamp discharge current to one side of the lamp cathode, and means operable during a second half-cycle of the AC signal to provide a lamp discharge current to the opPosite side of the lamp cathode. This thus has the effect of creating two hot spots rather than one on the lamp cathode, thus improving the maintenance on the cathode as well as providing more even heating of the cathode.

In connection with a more particular aspect of the present invention, the circuit is comprised of a pair of input terminals for receiving an alternating cycle signal thereacross. A ballast capacitor is coupled to one of these terminals, and a rectifier bridge intercouples the ballast, capacitor and the electrodes of the discharge lamp which are comprised of a lamp anode and a lamp cathode. The rectifier bridge is comprised of opposite bridge diode rectifier sides connected, respectively, to opposite ends of the lamp cathode. In this way the lamp discharge current flows to opposite ends of the cathode during alternate respective half-cycles of the alternating cycle signal.

BEST MODE FOR CARRYING OUT THE INVENTION

For a better understanding of the present invention, together with other and further objects, advantages and capabilities thereof, reference is made to the following disclosure and appended claims in conjunction with the accompanying drawings.

Figure 1:
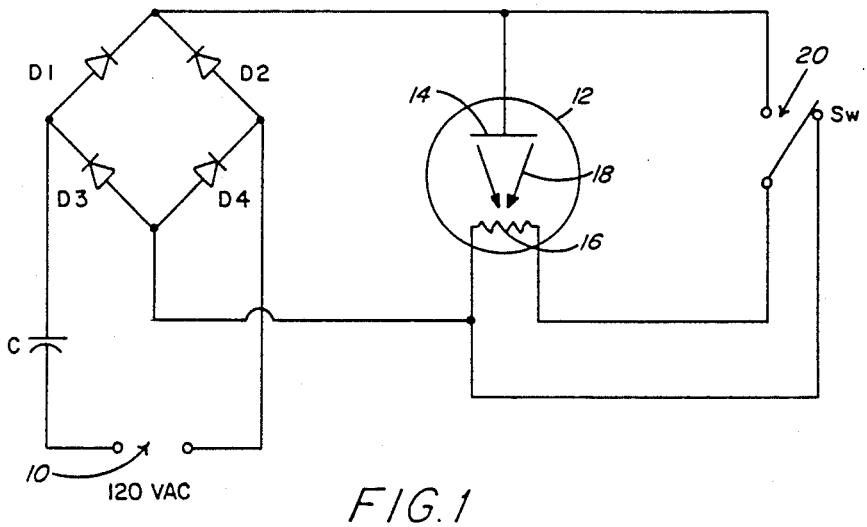
FIG. 1 PRIOR ART
FIG. 1 is a prior art electronic ballast circuit employing a capacitor ballast element and bridge circuit.

The present invention relates to an electronic ballast circuit and in particular an improved capacitive ballast for a discharge lamp such as a DC glow lamp. Reference has been made in FIG. 1 to a prior art capacitive ballast in which the discharge current flows to essentially the same point on the cathode during each half-cycle of the AC signal. The present invention represents an improvement and in the preferred embodiment, the improvement is disclosed in FIG. 2 herein. The improved electronic ballast circuit of the present invention is characterized by improved cathode operation and overall lamp operation. In this connection, rather than having the single point discharge of the prior art circuit of FIG. 1, there is provided in accordance with the present invention, in the preferred embodiment of FIG. 2, a double hot spot operation regime for the lamp cathode, which has the advantage of better cathode maintenance.

Figure 2:
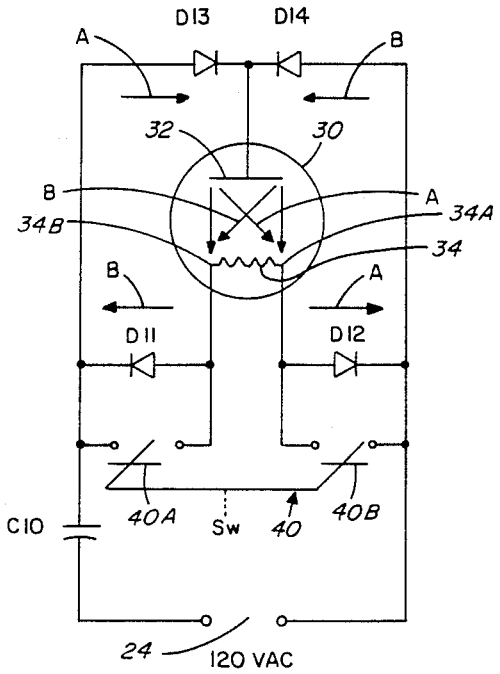
FIG. 2 is a circuit diagram of an electronic ballast circuit in accordance with the principles of the present invention.

Referring now to the specific circuit of FIG. 2, it is comprised of a ballast capacitor C10 and a rectifier bridge that is essentially split into two halves, thus allowing the discharge current to flow to opposite ends of the filament (cathode) during alternating half-cycles.

In FIG. 2 the rectifier bridge is comprised of diodes D11 and D13 on one side and diodes D12 and D14 on the other side. The cathode of diode D11 and the anode of D13 are coupled in common and to the capacitor C10. The capacitor C10 also connects to one of the input terminals 24. The anode of diode D11 connects to one side of the cathode 34. The cathode of diode D13 and the cathode of D14 are connected in common to the anode 32 of the DC glow discharge lamp 30.

On the other side of the rectifier bridge, the cathode of diode D12 and the anode of diode D14 connect in common and directly to one of the input terminals 24. The anode of diode D12 connects to the opposite end of the cathode 34, that is opposite to the connection of the diode D11 to the cathode 34. The cathode of the diode D14 connects to the anode 32 of lamp 30.

As indicated previously, the improved electronic ballast circuit of the present invention is characterized by a split rectifier bridge that enables discharge current to flow to opposite ends of the cathode during alternating half-cycles. During one-half of the cycle, the diodes D12 and D13 are conductive and the arrows A illustrate the discharge path to end 34A of the cathode 34. During the other half-cycle of the AC signal, only the diodes D11 and D14 are conductive. The arrows B illustrate this discharge path from the anode 32 to the opposite end 34B of the cathode 34.

With the particular bridge configuration of FIG. 2, it is noted that a somewhat different starter circuit arrangement is employed. This includes, for example, two glow bottles or similar starting aid. These are illustrated in FIG. 2 by the switches 40A and 40B. The switch 40A is across diode D11 and the switch 40B is across diode D12. The use of two switches rather than one presents no particular problem in terms of lamp operation.

The application of an input AC voltage at terminals 24 will cause a closure of the switch action devices 40A and 40B. The closure of this device will short out the two diodes D11 and D12 and provide an extremely low resistance path through the lamp cathode 34. The AC current flowing through the cathode at this time will cause the cathode to heat up (preheat). A short time later (several seconds — depending on the switch action) the switching device 40 will open-circuit and the lamp will start with current flowing through the lamp and alternately diodes D13, D12 and D14, D11. At start up (preheat) the capacitor C10 acts as a voltage divider element in conjunction with the cathode 34 to supply preheat current. During lamp operation the capacitor C10 behaves as a ballasting impedance with a magnitude of $1/j\omega C$. A very large percentage of the line voltage is dropped across the capacitor C10 during lamp operation but, due to the higher Q factor inherent in capacitors, the power loss is much smaller than would be the case for an inductor in a similar situation.

Thus, in accordance with the present invention, there is proposed an improved capacitive ballasting circuit employing a diode bridge, but one that is reconfigured so as to provide discharge current flowing to opposite ends of the filament during alternating half-cycles. Again, this is illustrated by the arrows A and B in FIG. 2 showing alternating discharge to opposite ends of the cathode filament. This operation provides the desirable effect of forming two cathode spots during normal lamp operation. By forcing the cathode to work in a double hot spot mode during lamp operation, there is an improvement in the maintenance of the cathode by preventing continuous barium evaporation from any one point on the cathode during lamp operation. The double hot spots furthermore make for a more even heating of the cathode by the discharge and thus provide improved lamp maintenance and performance.

While there has been shown and described what is at present considered the preferred embodiment of the invention, it will be obvious to those skilled in the art that various changes and modifications may be made therein without departing from the invention as defined by the appended claims.

What is claimed is:

1. An electronic ballast circuit for operating a DC discharge lamp comprising;

means defining a pair of input terminals for receiving an alternating cycle signal thereacross, a ballast capacitor coupled to one of said terminals, and a rectifier bridge intercoupling the ballast capacitor and the electrodes of said discharge lamp which are comprised of a lamp anode and lamp cathode, said rectifier bridge comprised of opposite bridge diode rectifier sides connected, respectively, to opposite ends of the lamp cathode, whereby DC lamp discharge current flows from said anode to opposite ends of the cathode during alternate respective half-cycles of the alternating cycle signal.

2. An electronic ballast circuit as set forth in claim 1 wherein each bridge side comprises a pair of diodes.

3. An electronic ballast circuit as set forth in claim 2 wherein a first diode of one bridge side and a first diode of the other bridge side are connected to the lamp anode.

4. An electronic ballast circuit as set forth in claim 3 wherein a second diode of the one bridge side and a second diode of the other bridge side are connected to respective ends of the cathode.

5. An electronic ballast circuit as set forth in claim 4 wherein both said first diodes also connect to the ballast capacitor.

6. An electronic ballast circuit as set forth in claim 5 wherein both said second diodes also connect to the other of said pair of input terminals.

7. An electronic ballast circuit as set forth in claim 2 including lamp starting switch means coupled to said lamp cathode.

8. An electronic ballast circuit as set forth in claim 7 wherein said lamp starting switch means includes a pair of switches coupled to respective ends of the cathode for facilitating lamp starting.

9. An electronic ballast circuit as set forth in claim 8 wherein a first diode of one bridge side and a first diode of the other bridge side are connected to the lamp anode, a second diode of the one bridge side and a second diode of the other bridge side are connected to respective ends of the cathode, one of said switches coupled across the second diode of the one bridge side and the other switch couples across the second diode of the other bridge side.

10. In an electronic ballast circuit for operating a DC discharge lamp from an AC source that provides an AC signal having half-cycles, said lamp having a lamp cathode and lamp anode said ballast circuit including a capacitive ballast elements, the improvement comprising a bridge rectifier circuit coupled from said ballast element and including means operable during a first half-cycle of the AC signal to provide a DC lamp discharge current from said anode to one side of the lamp cathode, and means operable during a second half-cycle of the AC signal to provide a DC lamp discharge current from said anode to the opposite side of the lamp cathode.

11. In an electronic ballast circuit as described in claim 10 wherein said means operable during a first half-cycle includes a pair of diodes, one coupled to the lamp anode and the other coupled to one side of the lamp cathode.

12. In an electronic ballast circuit as described in claim 11 wherein said means operable during a second half-cycle includes a pair of diodes, one coupled to the lamp anode and the other coupled to one side of the lamp cathode.

13. In an electronic ballast circuit as described in claim 12 including lamp starting switch means coupled to said lamp cathode.

14. In an electronic ballast circuit as described in claim 13 wherein said lamp starting switch means includes a pair of switches coupled to respective ends of the cathode for facilitating lamp starting.

15. In a capacitive ballast circuit for operating a discharge lamp from an AC signal, a method of operating the lamp so as to discharge current through the lamp to one side of the lamp filament during a first half-cycle of the AC signal, and to discharge current through the lamp to the opposite side of the lamp filament during a second half-cycle of the AC signal.

* * * * *